US008910813B1

(12) United States Patent
Barre et al.

(10) Patent No.: US 8,910,813 B1
(45) Date of Patent: Dec. 16, 2014

(54) LAUNDRY HAMPERS AND SORTERS WITH ACCESSIBLE FRONT LOADING REGIONS

(71) Applicant: Neatfreak Group Inc., Mississauga (CA)

(72) Inventors: Bertrand Barre, Lapeyrouse (FR); Francis Lepage, Dommartin (FR)

(73) Assignee: Neatfreak Group Inc., Mississauga, Ontario (CA)

( * ) Notice: Subject to any disclaimer, the term of this patent is extended or adjusted under 35 U.S.C. 154(b) by 0 days.

(21) Appl. No.: 14/036,988

(22) Filed: Sep. 25, 2013

(51) Int. Cl.
*B65D 21/02* (2006.01)
*D06F 95/00* (2006.01)

(52) U.S. Cl.
CPC ..... *D06F 95/004* (2013.01)
USPC ..... 220/23.83; 220/528; 220/495.09

(58) Field of Classification Search
USPC ..... 220/9.4, 23.83, 23.88, 23.89, 528, 220/495.09, 23.4
See application file for complete search history.

(56) References Cited

U.S. PATENT DOCUMENTS

| | | | | | |
|---|---|---|---|---|---|
| 2,625,973 | A | * | 1/1953 | Weldon et al. | 206/459.5 |
| 3,958,715 | A | * | 5/1976 | Capelli | 220/532 |
| 3,977,450 | A | * | 8/1976 | Schampier | 383/7 |
| 3,995,924 | A | * | 12/1976 | Jones | 312/211 |
| 4,585,283 | A | * | 4/1986 | Redmon et al. | 312/258 |
| 4,974,746 | A | * | 12/1990 | Dickinson | 220/495.09 |
| 4,979,705 | A | * | 12/1990 | Bovitz | 248/97 |
| 5,118,173 | A | * | 6/1992 | Proctor et al. | 312/213 |
| 5,154,359 | A | * | 10/1992 | Junta et al. | 280/79.2 |
| 5,190,252 | A | * | 3/1993 | Schrager | 248/97 |
| D336,696 | S | * | 6/1993 | Bateman et al. | D32/37 |
| 5,238,139 | A | * | 8/1993 | Bisceglia | 220/495.09 |
| D341,685 | S | * | 11/1993 | Brooks | D32/36 |
| 5,263,602 | A | * | 11/1993 | Lathouris | 220/23.83 |
| 5,380,081 | A | * | 1/1995 | Vogt | 312/212 |
| D404,861 | S | * | 1/1999 | Balensiefer, II | D32/37 |
| 5,967,342 | A | * | 10/1999 | Steffine | 211/85.24 |
| 6,062,416 | A | * | 5/2000 | Smillie | 220/524 |
| 6,691,879 | B1 | * | 2/2004 | Alvarez | 211/175 |
| 6,752,286 | B2 | * | 6/2004 | Liu | 220/9.4 |
| 6,761,367 | B2 | * | 7/2004 | Fite | 280/47.26 |
| 7,243,884 | B2 | * | 7/2007 | Lawson et al. | 248/95 |
| 8,381,936 | B1 | * | 2/2013 | Blake | 220/500 |
| 2001/0027977 | A1 | * | 10/2001 | Hall | 220/523 |
| 2003/0057171 | A1 | * | 3/2003 | Wang | 211/195 |
| 2003/0173359 | A1 | * | 9/2003 | Nester et al. | 220/23.4 |
| 2006/0157358 | A1 | * | 7/2006 | Heidel | 206/278 |

* cited by examiner

*Primary Examiner* — Fenn Mathew
*Assistant Examiner* — Christopher McKinley
(74) *Attorney, Agent, or Firm* — Patzik, Frank & Samotny Ltd.

(57) ABSTRACT

Laundry hampers and sorters are disclosed that are front loading, in that they permit removal and replacement of individual laundry bags without requiring the bags to be raised significantly in order to remove the laundry bags from a supporting frame. Removable laundry bags are supported, at least in part, by support members, such as front vertical posts having cupped or saddle-shaped supports disposed atop the vertical posts. As a result, the requirement for a top front horizontal bar of the frame is eliminated, permitting the laundry bags to be removed and replaced in position using a substantially horizontal direction of movement. This, in turn, provides ergonomic benefit, as significantly less physical effort is required to both remove and replace the laundry bags.

11 Claims, 3 Drawing Sheets

LAUNDRY HAMPERS AND SORTERS WITH ACCESSIBLE FRONT LOADING REGIONS

BACKGROUND OF THE INVENTION

1. Field of the Invention

The present invention relates, in general, to garment storage and, more particularly, to laundry hampers and sorters for storing and pre-sorting of garments prior to laundering them.

2. General Background of the Invention

Laundry hampers, and laundry sorters, comprising a garment storage hamper having two or more adjacent storage compartments within a common housing, have been known for some time. Today, such laundry sorters, in particular, often feature multiple removable laundry bags adjacently supported by a common frame. The use of removable laundry bags facilitates pre-sorting of garments by type prior to washing, such as separating white, light color, and dark color fabrics, so that each pre-sorted group of garments may be loaded directly into a washing machine. The use of removable laundry bags permits individual loads of pre-sorted laundry to be separately transported for placement within a washing machine.

Prior art laundry sorters having removable laundry bags, such as the one disclosed in U.S. Pub. No. 2006/0157358 A1, are commonly top loading in construction, meaning that removal and replacement of each supported laundry bag requires that the bag must be vertically lifted above the frame, in order to clear, among other structures, a top front horizontal bar or similar structure of the frame. Particularly during removal of the laundry bags, when they may be relatively heavily loaded with garments, vertically raising the bag above the frame may be cumbersome or difficult, particularly if the user is not physically strong, is relatively short in height, or is suffering from lower back pain or other physical ailment.

BRIEF SUMMARY OF THE INVENTION

The present invention provides laundry hampers and sorters that overcome many of the shortcomings of certain prior art laundry sorters. In particular, laundry hampers and sorters are disclosed that are front loading, meaning that they permit removal and replacement of individual laundry bags without requiring the bags to be raised significantly in order to remove the laundry bags from engagement of and storage within a supporting frame.

In the hampers and laundry sorters of the present invention, removable laundry bags are supported, at least in part, by front vertical posts having cupped or saddle-shaped supports disposed atop the vertical posts. As a result, the requirement for a top front horizontal bar is eliminated, permitting the laundry bags to be removed and replaced in position using a substantially horizontal direction of movement. This, in turn, provides a significant ergonomic improvement over certain prior art top loading laundry sorters, as significantly less effort is required to both remove and replace the laundry bags.

DETAILED DESCRIPTION OF THE INVENTION

Figure 1:
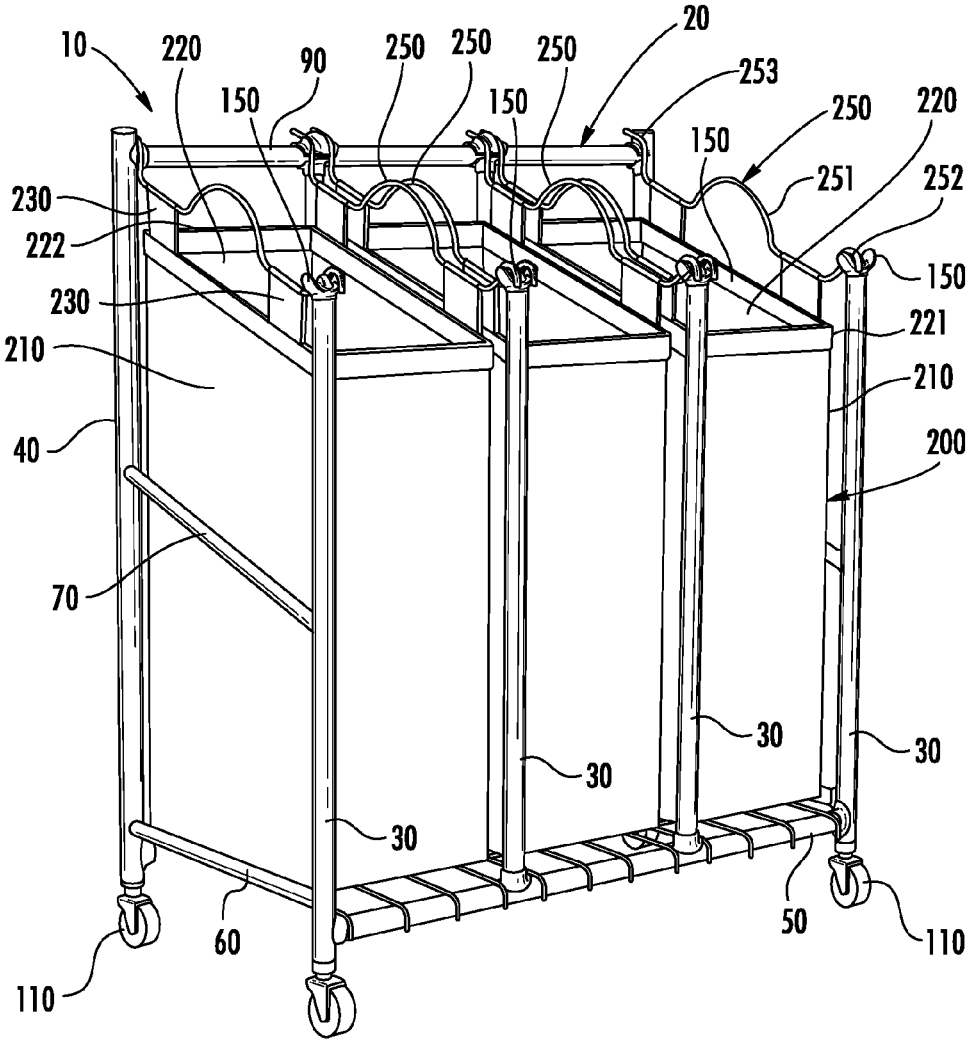
FIG. 1 an elevated, front perspective view of an embodiment of a laundry sorter of the present invention.
Figure 2:
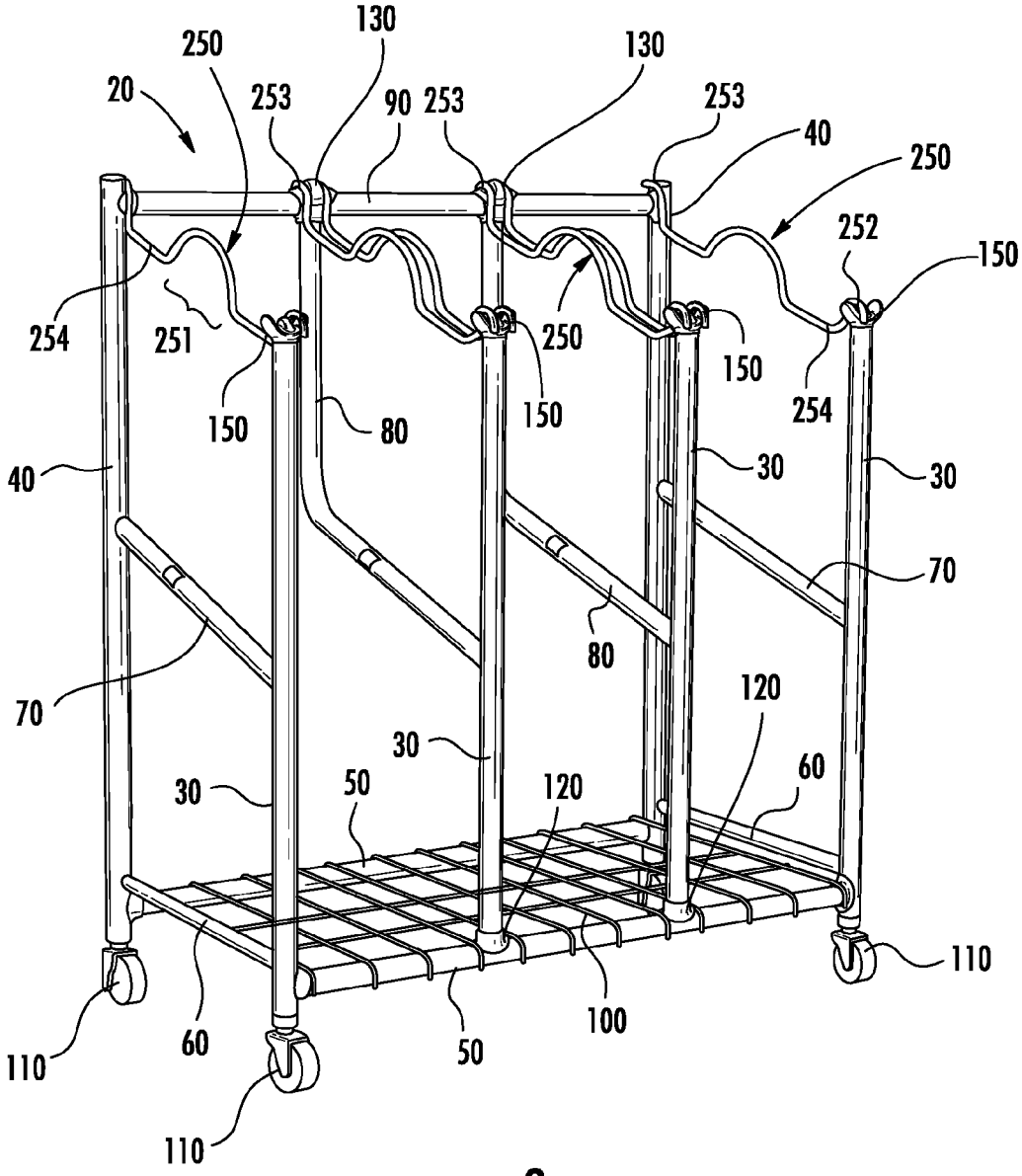
FIG. 2 is an elevated, front perspective view of the frame portion of the laundry sorter of FIG. 1 and further including, for illustrative purposes, only the hanger handle portions of the supported laundry bags.
Figure 3:
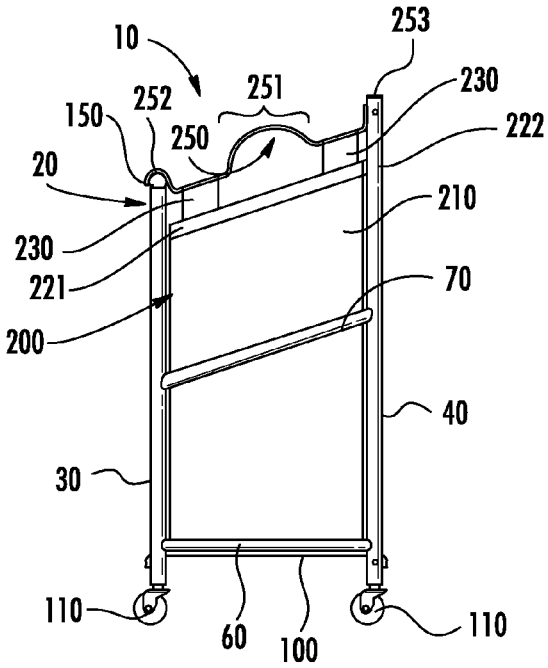
FIG. 3 is a right side view of the laundry sorter of FIG. 1.

While the present invention is susceptible of embodiment in many different forms, there is shown in the drawings and will herein be described in detail, several specific embodiments, with the understanding that the present disclosure is intended as an exemplification of the principles of the present invention and is not intended to limit the invention to the embodiments illustrated.

A first embodiment of the present laundry sorter 10 is shown in FIGS. 1-6 as comprising frame 20, supporting a plurality, in this embodiment three, of substantially adjacent removable laundry bags 200. Frame 20 may be constructed primarily of tubular steel or aluminum components and comprises four vertical front posts 30, two vertical rear posts 40, two bottom horizontal tubes 50, two bottom side tubes 60, and two angled side support tubes 70. Each front post 30 comprises an elongated, vertically oriented support member.

Angled side support tubes 70 each connect a respective outer front post 30 and rear post 40. Top rear horizontal tube 90 connects left and right rear posts 40. Two L-shaped support tubes 80 each connect a respective inner front post 30 to top rear horizontal tube 90 via T-coupling 130. T-couplings 130 may be constructed of a relatively rigid plastic material, and may include a cuff-shaped upper portion enabling a snap-fit engagement about top rear horizontal tube 90. T-couplings 130 may optionally include two opposing depressions or recessed regions to secure supported rear hooks 253 associated with laundry bags 200 against unwanted lateral movement.

Another form of T-couplings 120 connect two inner front posts 30 to front bottom horizontal tubes 50, and may likewise be constructed of a relatively rigid plastic material. Two bottom side tubes 60 each connect a respective outer front post 30 and rear post 40. Wire mesh surface 100 is disposed across front and rear bottom horizontal tubes 50. Caster wheels 110 are coupled to the bottom ends of each of outer front posts 30 and rear posts 40, permitting laundry sorter 20 to be rolled about.

Figure 4:
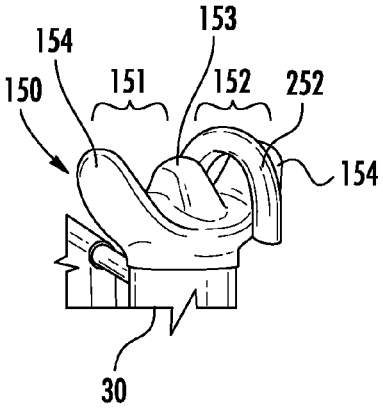
FIG. 4 is a perspective view of a saddle-shaped support of the laundry sorter of FIG. 1, showing, in particular, a front hook of a single laundry bag supported by a first cupped region of the saddle-shaped support.
Figure 5:
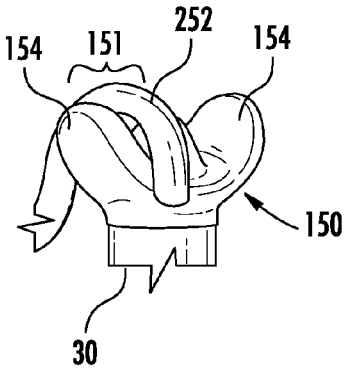
FIG. 5 is a perspective view of the saddle-shaped support of FIG. 4, showing, in particular, a front hook of a single laundry bag supported by a second cupped region of the saddle-shaped support.
Figure 6:
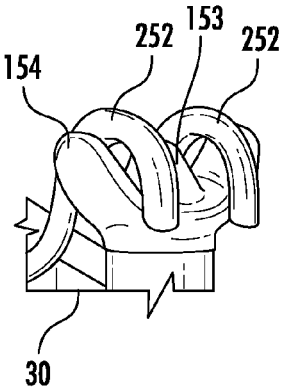
FIG. 6 is a perspective view of the saddle-shaped support of FIG. 4, showing, in particular, two front hooks of two laundry bags adjacently supported by both first and second cupped regions of the saddle-shaped support.

As best seen in FIGS. 4-6, four saddle-shaped laundry bag supports 150 are disposed atop respective front posts 30. Each saddle-shaped support 150 comprises a top saddle-shaped surface having two opposing outer risers 154, a first cupped region 151 and a second cupped region 152, separated by a center riser 153. Saddle-shaped support 150 may be constructed of a relatively rigid plastic material. Each cupped region comprises a depression, sunken region, recess or hollow disposed proximate a top surface of saddle-shaped support 150.

As best seen in FIG. 1, laundry sorter 10 further comprises three removable laundry bags 200, each comprising fabric body 210. Fabric body 210 may be generally parallelepiped on shape, and may include internal stiffeners about its vertical, top and bottom edges to inhibit folding or collapse of the fabric, such that laundry bag 200 substantially retains its generally parallelepiped configuration. Top opening 220 of laundry bag 200 is generally rectangular in configuration, and is angled or canted forward, such that front edge 221 is below rear edge 222, further facilitating the placement of garments into laundry bag 200.

Fabric body 210 of laundry bag 200 further comprises four side loops 230, each extending vertically from a side surface of fabric body 210 and each disposed proximate a respective corner of top opening 220. Two hanger handles 250 are coupled to each fabric body 210 using side loops 230. Each hanger handle 250 may be constructed of a relatively rigid material such as steel or aluminum, and comprises arcuate central carrying region 251, front hook 252 and rear hook 253. Two linear regions 254 of hanger handle 250 are disposed on either side of central carrying region 251 and adjacent front hook 252 and rear hook 253. Hanger handles 250 are attached to fabric body 210 by passing front hook 252 and rear hook 253 through respective side loops 230, until each side loop 230 is disposed about an associated linear region 254.

Each laundry bag 250 is releasably attachable at a predetermined position of frame 20, with frame 20 supporting front hook 252 and rear hook 253. Specifically, rear hook 253 is disposed about a top region of rear horizontal tube 90. And may be retained in position in cooperation with T-coupling 130, as described above. Simultaneously, front hook 252 is disposed atop an associated saddle-shaped laundry bag support 150, nestled within opposing raised side surfaces of either first cupped region 151 and second cupped region 152. As shown in FIG. 4, the saddle-shaped support 150 associated with leftmost front post 30 supports front hook 252 of a leftmost-positioned laundry bag 200 only upon second cupped region 152, with first cupped region 151 being left unused. As shown in FIG. 5, the saddle-shaped support 150 associated with rightmost front post 30 supports front hook 252 of a rightmost-positioned laundry bag 200 only upon first cupped region 151, with second cupped region 252 being unused. As shown in FIG. 6, the saddle-shaped supports 150 associated with each inner front post 30 each supports a first front hook 252 of a first laundry bag 200 upon first cupped region 151, and a second front hook 252 of a second laundry bag 200 upon second cupped region 252.

As can be seen, through the use of laundry bag handle supports disposed atop vertical posts, coupled with the absence of a top horizontal tube or similar frame structure that presents an obstruction proximate the front of the frame, each laundry bag may be removed through an associated forward opening region of the frame, by raising the hanger handles only slightly, such that the front and back hooks of the hanger handles clear the saddle shaped support supporting them, thereby permitting the laundry bag to then be carried forward, towards the user and out of the interior of the laundry sorter's frame. Accordingly, each laundry bag need not be raised above the height of the frame in order to remove it from the frame, as would be required by some prior art, top loading laundry sorters.

Although the previously described embodiment discloses a laundry sorter consisting of three laundry bags 200, with a frame that includes two inner front posts 30, differently sized laundry sorters having different numbers of supported laundry bags are also contemplated by the present invention, including, but not limited to: i) a frame 20 supporting a single laundry bag 200, with no inner front posts 30, and two outer front posts, 30, each having a saddle-shaped laundry bag support 150 disposed atop the front post 30; ii) a frame 20 supporting two laundry bags 200, with a single inner front post 30 and two outer front posts 30, each having a saddle-shaped laundry bag support 150 disposed atop the front post 30; and iii) a frame 20 supporting four laundry bags 200, with three single inner front posts 30 and two outer front posts 30, each having a saddle-shaped laundry bag support 150 disposed atop the front post 30.

Many modifications and variations of the present invention are possible in light of the above teachings. It is therefore to be understood that within the scope of the appended claims, the invention may be practiced other than as specifically described. Various modifications, changes and variations may be made in the arrangement, operation and details of performing the various steps of the invention disclosed herein without departing from the spirit and scope of the invention. The present disclosure is intended to exemplify and not limit the invention.

What is claimed is:

1. A garment storage hamper, comprising:

a frame having a top side having a top opening, a bottom side, a rear side, a left side, a right side, and a front side, a first outer vertical support member disposed at the left side of the frame, a second outer vertical support member disposed at the right side of the frame, a first inner vertical support member disposed between the first outer vertical support member and the second outer vertical support member, and at least two front openings disposed between the first outer vertical support member and the second outer vertical support member and extending through the front side of the frame, including first and second front openings disposed on opposing sides of the first inner vertical support member; and at least two laundry bags removably supported by the frame, each of the first and second outer vertical support members supporting a portion of a laundry bag, the first inner vertical support member supporting a first laundry bag on a first side of the first inner vertical support member and a second laundry bag on a second, opposing side of the first inner vertical support member;

wherein the frame does not include a top front horizontal support member extending from the first outer vertical support member to the second outer vertical support member across the front side of the frame and proximate the top side of the frame, the frame does not include a top front horizontal support member extending from the first outer vertical support member to the first inner vertical support member across the front side of the frame and proximate the top side of the frame, and the frame does not include a top front horizontal support member extending from the first inner vertical support member to the second outer vertical support member across the front side of the frame and proximate the top side of the frame, thereby permitting both the first laundry bag and the second laundry bag to be pulled outward through the front side of the frame through respective front openings without requiring either the first laundry bag or the second laundry bag to be removed by raising either the first laundry bag or the second laundry bag through the top opening of the frame.

2. The invention according to claim 1, wherein:

the frame further includes a second inner vertical support member disposed between the first inner vertical support member and the second outer vertical support member, the at least two laundry bags comprise at least three laundry bags; and the second inner vertical support member supporting the second laundry bag on a first side of the second inner vertical support member and a third laundry bag on a second, opposing side of the second inner vertical support member, wherein the frame does not include a top front horizontal support member extending from the first outer vertical support member to the second inner vertical support member across the front side of the frame and proximate the top side of the frame, the frame does not include a top front horizontal support member extending from the first inner vertical support member to the second inner vertical support member across the front side of the frame and proximate the top side of the frame, and the frame does not include a top front horizontal support member extending from the second inner vertical support member to the second outer vertical support member across the front side of the frame and proximate the top side of the frame, thereby permitting the first, second and third laundry bags to be pulled outward through the front side of the frame through respective front openings without requiring the first, second or third laundry bag to be removed by raising the first, second or third laundry bag through the top opening of the frame.

3. The invention according to claim 1, wherein at least one of the first outer vertical support member, second outer vertical support member, and first inner vertical support members further includes at least one depression configured to support and releasably retain at least a portion of an associated laundry bag.

4. The invention according to claim 3, wherein at least one laundry bag includes a handle, and the at least one depression is configured to support and releasably retain at least a portion of the handle of the laundry bag.

5. The invention according to claim 3, wherein at least one laundry bag includes a hook, and the at least one depression is configured to support and releasably retain the hook of the laundry bag.

6. The invention according to claim 1, wherein at least one of the first outer vertical support member, second outer vertical support member, and first inner vertical support members further includes at least two depressions, each depression being configured to releasably retain at least a portion of an associated laundry bag.

7. The invention according to claim 1, wherein at least one of the first outer vertical support member, second outer vertical support member, and first inner vertical support members further includes a saddle-shaped member.

8. The invention according to claim 7, wherein the saddle-shaped member includes at least one depression configured to releasably retain at least a portion of an associated laundry bag.

9. The invention according to claim 7, wherein the saddle-shaped member includes at least two depressions, each configured to releasably retain at least a portion of an associated laundry bag.

10. A garment storage hamper, comprising:

a frame having a top side having a top opening, a bottom side, a rear side, a left side, a right side, and a front side, a first outer vertical support member disposed at the left side of the frame, a second outer vertical support member disposed at the right side of the frame, at least one inner vertical support member disposed between the first outer vertical support member and the second outer vertical support member, and at least two front openings extending through the front side of the frame, including a first front opening disposed between the first outer vertical support member and the at least one inner vertical support member, and a second front opening disposed between the at least one inner vertical support member and the second outer vertical support member; and a plurality of laundry bags removably supported by the frame, at least one laundry bag being removably supported in part by the first outer vertical support member, at least one laundry bag being removably supported in part by the second outer vertical support member, and two laundry bags being removably supported in part by each of the at least one inner vertical support member;

wherein the frame does not include a top front horizontal support member extending from the first outer vertical support member to the second outer vertical support member across the front side of the frame and proximate the top side of the frame, the frame, the frame does not include a top front horizontal support member extending from the first outer vertical support member to the at least one inner vertical support member across the front side of the frame and proximate the top side of the frame, and the frame does not include a top front horizontal support member extending from the at least one inner vertical support member to the second outer vertical support member across the front side of the frame and proximate the top side of the frame, thereby permitting the plurality of laundry bags to be pulled outward through the front side of the frame, each through a respective front opening, without requiring the plurality of laundry bags to be removed by raising the plurality of laundry bags through the top opening of the frame.

11. A garment storage hamper, comprising:

a frame having a top side having a top opening, a bottom side, a rear side, a left side, a right side, and a front side, a first outer vertical support member disposed at the left side of the frame, a second outer vertical support member disposed at the right side of the frame, at least two inner vertical support members including a first inner vertical support member and a second inner vertical support member, the first inner vertical support member being disposed between the first outer vertical support member and the second inner vertical support member, the second inner vertical support member being disposed between the first inner vertical support member and the second outer vertical support member, and at least three front openings extending through the front side of the frame, including a first front opening disposed between the first outer vertical support member and the first inner vertical support member, a second front opening disposed between the first inner vertical support member and the second inner vertical support member, and a third front opening disposed between the second inner vertical support member and the second outer vertical support member; and a plurality of laundry bags removably supported by the frame, at least one laundry bag being removably supported in part by the first outer vertical support member, at least one laundry bag being removably supported in part by the second outer vertical support member, two laundry bags being removably supported in part by the first inner vertical support member, and two laundry bags being removably supported in part by the second inner vertical support member;

wherein the frame does not include a top front horizontal support member extending from the first outer vertical support member to the second outer vertical support member across the front side of the frame and proximate the top side of the frame, the frame does not include a top front horizontal support member extending from the first outer vertical support member to the first inner vertical support member across the front side of the frame and proximate the top side of the frame, the frame does not include a top front horizontal support member extending from the first inner vertical support member to the second inner vertical support member across the front side of the frame and proximate the top side of the frame, and the frame does not include a top front horizontal support member extending from the second inner vertical support member to the second outer vertical support member across the front side of the frame and proximate the top side of the frame, thereby permitting the plurality of laundry bags to be pulled outward through the front side of the frame, each through a respective front opening, without requiring the plurality of laundry bags to be removed by raising the plurality of laundry bags through the top opening of the frame.

* * * * *